United States Patent [19]

Kurz

[11] Patent Number: 4,922,617

[45] Date of Patent: May 8, 1990

[54] ELECTRICALLY DRIVEN CAN OPENER

[75] Inventor: Reinhard Kurz, Nidderau, Fed. Rep. of Germany

[73] Assignee: Braun Aktiengesellschaft, Kronberg, Fed. Rep. of Germany

[21] Appl. No.: 231,154

[22] Filed: Aug. 11, 1988

[30] Foreign Application Priority Data

Sep. 2, 1987 [DE] Fed. Rep. of Germany ..... 3729259

[51] Int. Cl.[5] ..... B25F 3/00

[52] U.S. Cl. ..... 30/419; 30/421

[58] Field of Search ..... 30/401, 419–421, 30/434

[56] References Cited

U.S. PATENT DOCUMENTS 2,979,815 4/1961 Rohde .
3,706,135 12/1972 Fukunaga .
4,534,108 8/1985 Yamamoto et al. ..... 30/419

FOREIGN PATENT DOCUMENTS 3048063 7/1982 Fed. Rep. of Germany .

*Primary Examiner*—Douglas D. Watts
*Attorney, Agent, or Firm*—Fish & Richardson

[57] ABSTRACT

The electrically driven can opener is composed of a housing (1) accommodating a drive mechanism, a drivable drive wheel (2) which is located on the outside of a housing wall (3), a cutter (8) rotatably supported on the housing wall (3) at a distance from the drive wheel (2) and an operating member (22) to be operated by hand and mounted on the housing (1), which latter member serves to swivel the cutter (8) from a clamp-on position into a cutting position and to switch on the drive motor by means of a switch (38). The operating member (22) and the cutter (8) are interconnected by a spring-elastic element (19).

16 Claims, 3 Drawing Sheets

ELECTRICALLY DRIVEN CAN OPENER

This present invention relates to an electrically driven can opener having a housing accommodating a drive motor and a drive mechanism, a drive wheel which is arranged on the outside of a housing wall and is drivable by the drive motor and the drive mechanism, a cutter which is rotatably supported on the housing wall spaced apart from the drive wheel and severing the lid of a can, and an operating member to be actuated by hand and supported on the housing which permits to tilt the cutter from a clamp-on position into a cutting position and to switch on the drive motor by way of a switch.

A known can opener of the type referred to hereinabove (German published patent application No. 30 48 063) arranges for the cutter to be mounted on the operating member which actuates the switch at the same time. Both component parts are located on the outside of the housing wall. To operate the can opener, first the operating member with the cutter is swivelled, and the switch is actuated which switches on the drive motor for the drive wheel. Piercing and cutting open of a can lid will then take place automatically with the aid of the electric drive, the operating member with the cutter being automatically moved into the can, that is into the cutting position. In the cutting position, the cutter takes support on the operating member so that the operating member will automatically remain in the switch-on position until the cutting action is terminated.

This known can opener involves the disadvantage that it is not easily possible to interrupt the cutting action once it is begun, since the torque applied during the cutting action from the cutter onto the operating member retains the switch in the switch-on position. Hence the user has to put up with the fact that in each case the can lid will be cut off completely, unless he/she wants to forcefully retract the operating member into its initial position. Further, it has to be regarded as less favourable that the cutter must be pierced into the can lid by the operating member before the drive motor is moved by the switch to rotate. This concept will inevitably have as a result that a comparatively long lever must be used as an operating member in order to generate the piercing force. The rigid connection between operating member and cutter including the long lever results in large actuating travels of the operating member and undesirable force application on the operating member by the cutter, what makes it considerably more difficult to handle the can opener.

Therefore, it is the object of the instant invention to devise a can opener of the type initially referred to which affords simple and low-cost manufacture, which is safe and straightforward to use, wherein the operating member remains unaffected by the cutter's forces and which permits to interrupt the cutting action at any time. Further, it is aimed at by this invention that the can opener can be switched on only in the event of a can being clamped onto the drive wheel.

This object is achieved owing to the present invention in that a spring-elastic element is designed in the area of transmission from the operating member to the cutter, and in that the switch is arranged in relation to the element switching it on in such a fashion that the switch is allowed to be switched on caused by further actuation of the operating member only after the cutter has been put onto the can lid and only after the spring-elastic element has deformed. This inventive arrangement accomplishes several advantages. A first advantage is that the spring-elastic element ensures that the element switching on the switch is not applied by appreciable forces generated during the cutting action so that it is possible at any time to switch off the motor by virtue of the single switch-on element. It is another advantage that with all cans—no matter what distance there is between the can lid and the mounting surface of the drive wheel on the can lip—the said drive wheel will only be caused to rotate if it is ensured that the cutter abuts with sufficient press-on force on the can lid. Only then will the cutter automatically pierce into the can lid when the drive motor is put into operation.

Owing to the spring-elastic element and the predefined distance between the switch and the switch-on element, it will be furthermore achieved in an advantageous manner that the can opener is allowed to switch on only if a deformation of the spring-elastic element takes place, that means if actually a can is clamped onto the can opener and thus the switch is switched on caused by deformation of the spring-elastic element.

Another advantage resides in that, after the cutter is abutting on the can lid, further actuation of the element actuating the switch will cause the spring-elastic element to be biassed with a low preloading force so that likewise the cutter will be pressed with preload against the can lid. Namely, in the event of a corresponding cutting geometry, this preloading force alone will be sufficient to automatically pierce the cutter into the can lid—as soon as the drive wheel causes the can to turn without any resetting forces acting upon the element actuating the switch. This necessitates a particularly short lever as an operating member.

Furthermore, the present invention requires only one single operating element for actuating the cutter and for actuating the switch. Another advantage according to this invention which is important just the same is that, during the cutting action, the spring-elastic element will relax at any time by the actuating element swivelling back, and that it is thereby possible to switch off the drive motor, although the cutter remains in its cutting position. Subsequently, it will be easily possible at any time to take off the can from the cutter and the drive wheel despite the can lid has not yet been cut off completely from the can.

An improvement of the present invention arranges that the element actuating the switch is the operating member, and that this operating member is mechanically coupled with the cutter via the spring-elastic element. In this assembly, the spring-elastic element is a self-acting component part so that the cutter and the operating member can be disposed at different locations. In consequence thereof, the mounting support of the operating member can be spaced from the cutter's support, thereby allowing the lever to be placed favourably on the housing of the can opener, both as regards ergonomic points of view and for reasons of safety. Therefore, the inventive can opener affords a particularly handy and expedient housing design. The operating member which is e.g. designed as a lever can be located inside a hand-grip formed by a closed frame, so that there is little risk of inadvertently actuating the can opener. Owing to the spring-elastic element being designed as a separate component part, it lends itself to especially accurate manufacture as concerns its strength and the spring characteristic curve. This permits to more sensitively actuate the operating member and thus to better handle the can opener.

Instead of having a separate component part as spring-elastic element, the said's function can also be performed by the operating member alone which is available anyway. In this arrangement, the operating member is preferably coupled directly with the cutter so that no elastic deformation will be caused in this area when the operating member is actuated. The elastic deformation will be produced rather on the operating member designed as an elastic lever, and, that is to say, in such a way that, after the cutter is abutting on the can lid, further pulling of the operating member will cause it no more to twist, but to only deform along the lever's length until the switch is actuated.

The spring-elastic element can be manufactured particularly straightforwardly and cost-efficiently if it is made of spring wire and if roughly rectangularly deflected ends extend into eccentric bores in the operating member and in the cutter. Owing to the eccentric bores, the movement initiated at the lever will be transmitted as a rotary motion onto the cutter. When appropriately dimensioned, the spring-elastic element disposed in the path of transmission between the lever and the cutter will permit the drive motor to be switched on prior to the cutter being pierced into the can lid.

In order to be able to initiate the rotary motion at the cutter in a simple manner, the operating member is composed of a lever that is rotatably supported on the housing, and the spring-elastic element is coupled with a coupling member incorporated in the housing and connected with a shaft carrying the cutter. Instead of the lever designed as operating member, a slide member can also be used so that an eccentric bore is designed on the coupling member only.

To dismount the cutter from the can opener, it is arranged for in an improvement of this invention that the coupling member is detachably coupled with the shaft. Such dismounting permits simple cleaning and replacement of the cutter.

For straightforwardly securing the spring-elastic element in one or in both of the eccentric bores, it is provided that one or both of the ends of the spring-elastic element is/are of Z-shaped design. The coupling rod formed by spring wire will sag after the cutter has come into abutment on the edge of the can lid when the lever is tilted further until the switch-on position is reached.

To increase the elasticity, in addition, at least one end of the spring-elastic element can be deflected several times. In order to still further increase the elasticity of the coupling rod formed of any spring wire—to the end of accomplishing buckling under pressure load that is defined by the load's magnitude—another proposal suggests that the mid-portion of the spring-elastic element be shaped to be a helix wound one time or several times. In order to accomplish buckling defined by the direction, the helix can be located eccentrically in relation to the longitudinal axis of both of the lateral areas of the spring-elastic element.

Preferably, the spring-elastic element can be made of metal and/or plastics. Herein, also rubber-elastic plastics can be employed. When combining the materials metal/plastics, it is possible that the two rims are interconnected by means of a rubber-elastic element.

The distance between the operating member and the switch must be sized such that, upon actuation of the operating member, the latter will actuate the switch and thus switch on the drive motor by deformation of the spring-elastic element only after the cutter has clamped onto the can lid.

To simplify the handling of the inventive can opener, it is furthermore provided according to the instant invention that the cutter, the coupling member, the spring-elastic element and the operating member are movable by a return spring to assume their initial positions. These component parts are this way principally in their initial position when they are in their inactive position. The initial position permits to easily put on and actuate the can opener by hand.

To transmit the rotary movement from the coupling member onto the shaft of the cutter, according to another suggestion of this invention, the end of the shaft furnished with a flattened portion will grip in a non-torsional fashion into a flattened portion which is matingly designed in a bore of the coupling member.

In order to minimize the mounting space, when viewed in an axial direction of the cutter's shaft, it is arranged for to design the coupling member as a flat circular disc with a radial lever arm containing an eccentric bore. This circular disc allows to be made particularly easily as a stamped part, provided it is made of metal, or as a shaped part, provided it is made of plastics.

In can openers having a non-dismountable cutter, the coupling member can be coupled undetachably with the shaft. In contrast thereto, a can opener with a removable cutter requires the coupling member to be detachably coupled with the shaft. For securing the shaft in position in its axial direction relative to the housing, inventively, there is provision of an unlockable locking bolt engaging into a groove that is designed in the shaft This unlockable locking bolt is retained in its initial position by a spring acting in opposition to the release direction of the locking bolt and thus will always ensure that the shaft is safely fixed in the can opener. Simultaneously, an operating button attached in the housing for actuating the locking bolt is kept in its initial position.

Another preferred embodiment of this invention arranges that the rotatability of the cutter beyond an extreme cutting position is bounded by a stop, and that upon actuation of the operating member into the end position of the cutter defined by this stop—without a can being severed—the operating member is allowed to be moved further into a position, in which the switch will then be closed, only by applying load on the spring-elastic element disposed between the operating member and the shaft. This is because it may happen in practical operations that a user will inadvertently actuate the operating member until its stop, although no can has been hung onto the can opener. In this case, first the cutter will turn until it reaches its end position on the stop, while covering the drive wheel from the side and the front. This eliminates the danger of injury being caused by the cutter in this position, even if the other hand causes further rotation of the operating member—the cutter remains in its end position—in consequence whereof the drive motor is switched on and the drive wheel is caused to rotate. This inventive design affords a childproof safety arrangement.

For the event that only the cutter is turned inadvertently until its end position, it is provided by this invention that the cutter is unable to move the operating member by virtue of the spring-elastic element into a position in which it would actuate the switch. This arrangement, too, eliminates the risk of injury (another childproof safety arrangement), since the drive motor will not be switched on and thus the drive wheel will not turn either.

According to another proposal of this invention, it can also be prevented that the drive motor is switched on by rotation of the cutter in that closing of the switch takes place in a tilting area of the operating member in which one end of the spring-elastic element is in a dead-center position.

Hereinbelow, the instant invention will be explained in more detail with reference to an embodiment illustrated in the accompanying drawings. In the drawings, FIG. 1 is a partial cross-section taken through the inventive can opener in the area of the cutter's mounting support;

Figure 1:
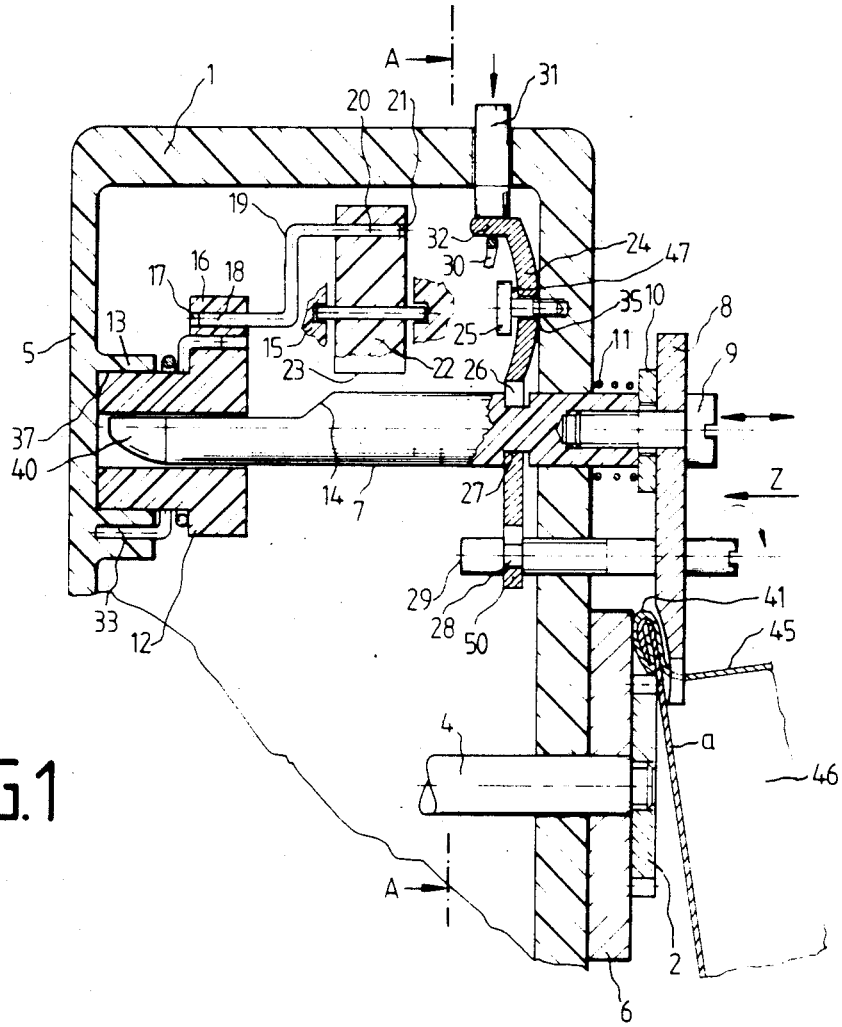

The illustrated can opener is composed of a substantially square-shaped housing 1 accommodating a gearbox, not referred to in detail, with an electric drive motor (likewise not shown) for a drive wheel 2. This drive wheel 2 is placed on the outside of a housing wall 3 and is screwed to a drive shaft 4 which penetrates the housing wall 3 and which is supported in the latter and in an oppositely lying housing wall 5. Intermediate the drive wheel 2 and the housing wall 3, a spacer 6 is disposed on the drive shaft 4 which transmits the press-on force caused during the cutting action onto the housing wall 3. The external diameter of the spacer 6 is larger than the external diameter of the toothed drive wheel 2 and this way affords an additional lateral guidance for the can's rim 41 which counteracts tilting of the can or, if the can 46 is fixed in position, tilting of the can opener.

In parallel to the drive shaft 4, a shaft 7 is supported in the housing 1 which carries a cutter 8 on its end projecting from the housing wall 3. This cutter 8 is secured to the frontal end of the shaft 7 by a screw 9 in a non-torsional and axially undisplaceable manner. Disposed on the shaft 7 is a shim 10 on which a compression spring 11 takes support that abuts on the housing wall 3.

In the interior of the housing 1, the end of the shaft 7 extends into a bore 37 of a sleeve 12 which is designed as coupling member and which is supported in a bearing eye 13 on the housing wall 5. To be able to transmit a rotary motion onto the shaft 7 via the sleeve 12, the end of the shaft 7 extending into the sleeve 12 is furnished with a flattened portion 14 with which a flattened portion 15 designed in the bore 37 of sleeve 12 is in engagement.

Figure 2:
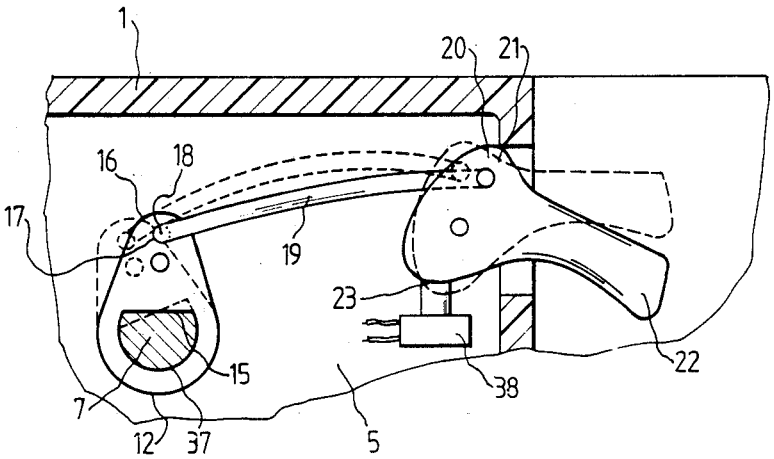
FIG. 2 is a partial view A of the can opener according to FIG. 1.

According to FIGS. 1 and 2, sleeve 12 includes an arm 16 with a bore 17 into which the deflected end 18 of the springelastic element made of spring wire is engaging in the form of a coupling rod 19. The other deflected end 20 of the coupling rod 19 extends into a bore 21 in a lever 22 which, according to FIG. 1, is placed behind the sectional plane and supported rotatably in the housing 1 and serves to operate the can opener. Furthermore, lever 22 is provided with a cam 23 for the actuation of a switch 38 (FIG. 2).

In an axial direction, the shaft 7 is held by a locking bolt 24 designed as a plate and being supported on the inner side of the housing wall 3 in a fashion slidable on pins 25 from the top to the bottom and vice-versa. Contained in the plate 24 is a bore 26 through which the shaft 7 is extending. In the illustrated position according to FIG. 1, the edge of the bore 26 engages into a groove 27 designed in the shaft 7 and thereby forms an axial bearing which retains the shaft 7 in axial direction on the housing 1. At a distance from the pins 25, the plate 24 grips with a forked end 50 into a groove 28 which is designed at a stop 29 that is shaped as a guide pin and is screwed into the housing wall 3. The screw-in depth of the guide pin 29 into the housing 1 permits to vary the distance between the plate 24 and the housing wall 3. This way, the guide pin 29 permits to precisely adjust the axial position of the shaft 7 and hence the distance 'a' of the cutter 8 in relation to the drive wheel 2.

In its illustrated locked position (FIG. 1), said plate 24 is urged upwardly in the drawing by means of a flexible clamp 30. In order to be able to remove the cutter 8 together with the shaft 7 from the housing 1, a push button 31 penetrating the housing 1 is provided on the upper side of the housing 1, the said push button abutting on the edge of an angled-off portion 32 shaped on the plate 24. When the push button 31 is actuated in the direction of the shaft 7, the plate 24 is able to displace in opposition to the force of the flexible clamp 30 so far downwardly until the edge of the bore 26 extends out of the groove 28 and the bore 26 aligns with the shaft 7. Subsequently, the shaft 7 is automatically displaced to the right under the action of the compression spring 11 so that the plate 24 is no more able to catch the groove 26. The cutter 8 and the shaft 7 can now jointly be removed from the housing 1, e.g. for cleaning purposes, even after the push button is released. In order to facilitate renewed mounting of the shaft 7 into the housing 1, the end of the shaft 7 is furnished with a chamfer 40 whose smallest diameter engages into the bore 26 even if the plate 24 is not depressed and, upon further displacement of the shaft 7, will draw the plate 24 downwardly.

Figure 4:
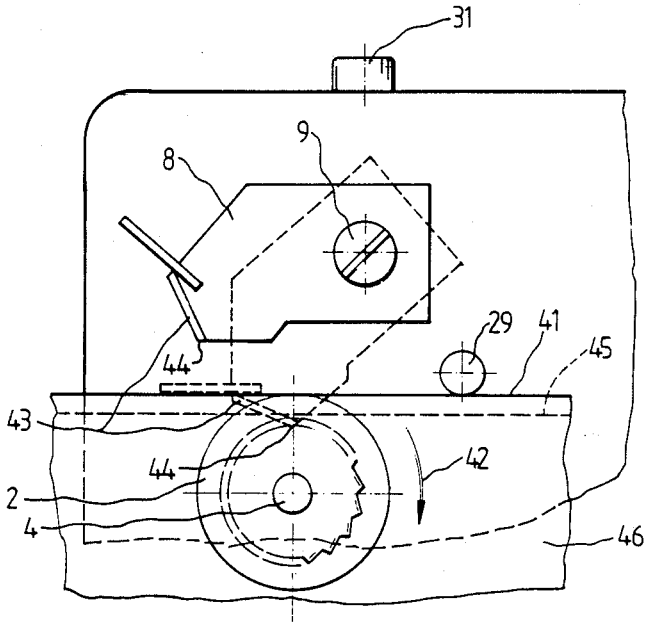
FIG. 4 is a lateral view on the can opener in the direction Z according to FIG. 1.

When the cutter 8 is in the cutting position (shown in dotted lines in FIG. 4), its cutting edge 43 will be disposed in the direction of rotation 42 of the drive wheel 2 in front of the latter. In order to reach this position, the cutter 8 must be swivelled by operating the lever 22 (FIGS. 1 and 2) against the return spring 33 abutting on sleeve 12. In doing so, the coupling rod 19 transmits the rotary movement of the lever 22 onto the sleeve 12 which, via the flattened portion 15, entrains the shaft 7 in its movement. Yet the rotary force which can be produced by this action is not sufficient to pierce the cutter 8 with its piercing tip 44 into the can lid 45 at the beginning of a cutting action. Therefore, the coupling rod 19 is elastically deformable to such extent (see dotted illustration in FIG. 2) that the lever 22 can be turned to assume the position required for operating the switch 38 when the cutter 8 is in abutment on the can lid 45. Only when the drive wheel 2 is driven will the cutter 8 automatically pierce into the can lid 45 due to the existing cutting geometry, whereupon the cutter 8 swivels into its final cutting position (see dotted illustration in FIG. 4) and the coupling rod 19 will relax again to the largest extent.

This is because the residual contact pressure force is required for the no-load conveyance, that means turning of the can 46 by the drive wheel 2 in the area of the already existing cut slit.

As long as the lever 22 is held by the hand of a user in the position illustrated in dotted lines in FIG. 2, the can 46 (FIG. 4) is driven via its can rim 41 by the drive wheel 2 and is turned during this action, and simultaneously the lid 45 is cut by the cutter 8 as long as said lid 45 is not already completely severed from the rest of the can 46.

When the lever 22 is returned to its initial position after the cutting operation is terminated, it will first operate the switch 38 which will switch off the can opener's drive motor. At the same time, the spring-elastic element 19 is relieved from tension and draws the sleeve 12 into its initial position which, in turn, swivels the shaft 7 together with the cutter 8 back into their initial position. The automatic resetting action is safeguarded by the return spring 33 only.

If it is desired to terminate or interrupt the cutting operation when the lid 45 is severed but partly, first the switch-on pressure acting on the lever 22 must be removed. Then the lever 22 will turn back to its initial position as far as it is moved back in the direction of its initial position caused by the movement released when the spring-elastic element 19 is relieved from load. The switch 38 is actuated at the same time during this sequence of motion and switches off the drive motor. The cutter 8 is retained in the cutting position. In order to release the cutter 8 from the cut slit, the can opener is slightly swivelled upwards, while the can 46 is held in position. Thus, the cutter 8 frees from the cut slit and is returned by the return spring 33 into its inital position.

Figure 3:
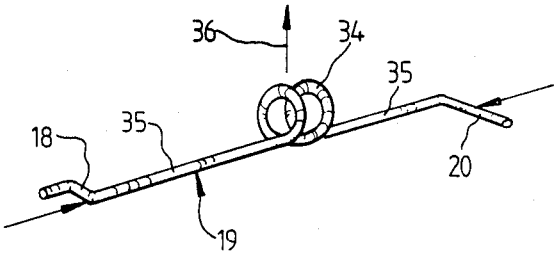
FIG. 3 is a different design of a spring-elastic element for a can opener according to FIG. 1.

FIG. 3 illustrates a variant of the coupling rod 19 which is made of spring wire and wherein, for increasing the elasticity, the mid-portion of the spring-elastic element 19 is bent to form a helix 34 wound two times. Extending from the helix 34 are substantially straight portions 35 to the two deflected ends 18, 20 of the coupling rod 19. These portions 35 are disposed on one joint longitudinal axis which is tangent to the windings of the eccentrically arranged helix 34. The deflected ends 18, 20 are disposed in one joint plane, and the helices 34 are arranged substantially above this plane, when viewed in the drawing. Owing to this design, defined buckling of the coupling rod 19 is accomplished when pressure forces are applied on its deflected ends 18, 20. During this buckling action, the helices 34 are somewhat compressed and deformed; subsequently, they bend upwardly in the direction of the arrow 36. The degree of elasticity and the direction of buckling can be predetermined in the desired fashion by the number and the position of the windings of helix 34. The design of the coupling rod 19 according to FIG. 3 therefore offers the constructor plenty of scope for devising the force transmission from the lever 22 onto the sleeve 12 and from there onto the shaft 7 of the cutter's support.

I claim:

1. Electrically driven can opener having a housing accommodating a drive motor and a drive mechanism, a drive wheel arranged on the outside of said housing and drivable by said drive motor and said drive mechanism, a switch for energizing said drive motor, a cutter rotatably supported on said housing spaced apart from said drive wheel for severing the lid of a can, an operating member to be actuated by hand and supported on said housing for actuating said switch and a spring-elastic element of spring wire, whose roughly rectangularly deflected ends extend into eccentric bores in said operating member and in said cutter, and which permits tilting of said cutter, said switch being arranged in relation to said operating member such that said switch is switched on by further actuation of said operating member only after said wire has been deformed and said cutter has been put into engagement with the can lid.

2. Electrically driven can opener having a housing accommodating a drive motor and a drive mechanism, a drive wheel arranged on the outside of said housing and drivable by said drive motor and said drive mechanism, a switch for energizing said drive motor, a cutter rotatably supported on sadi housing spaced apart from said drive wheel for severing the lid of a can, an operating lever to be actuated by hand and rotatably supported on said housing, for switching on said drive motor by way of said switch, and a spring-elastic portion coupled with a coupling member in said housing (1) and connected with a shaft that carries said cutter, said spring-elastic portion being disposed between said operating lever and said cutter for tilting of said cutter, said switch being arranged in relation to said operating lever such that said switch is switched on by further actuation of said operating lever only after said spring-elastic portion has been deformed and said cutter has been put into engagement with the can lid.

3. Can opener as claimed in claim 2 wherein said coupling member is detachably coupled with said shaft .

4. Can opener as claimed in claim 1 wherein at least one of the ends of said spring wire is of Z-shaped design.

5. Can opener as claimed in claim 4, characterized in that at least one end of the spring-elastic element (19) is defected several times.

6. Can opener as claimed in claim 1 wherein a portion of said spring wire is shaped to be a helix.

7. Can opener as claimed in claim 6 wherein said helix is arranged eccentrically in relation to the longitudinal axis of at least one of the lateral areas of said spring wire.

8. Can opener as claimed in any one of claims 1 and 4 to 10 wherein said spring wire is made of metal and /or plastics.

9. Electrically driven can opener having a housing accommodating a drive motor and a drive mechanism, a drive wheel arranged on the outside of said housing and drivable by said drive motor and said drive mechanism, a switch for energizing said drive motor, a cutter rotatably supported on said housing spaced apart from said drive wheel for severing the lid of a can, an operating member to be actuated by hand and supported on said housing for switching on said drive motor by way of said switch, a spring-elastic portion in the area of transmission between said operating member and said cutter which permits tilting of said cutter, said switch being arranged in relation to said operating member such that said switch is switched on by further acutation of said operating member only after said spring-elastic portion has deformed and said cutter has been put into engagement with the can lid, and a return spring, said cutter, said spring-elastic portion and said operating member being movable by said return spring to assume their initial positions.

10. Can opener as claimed in claim 2 and further including a shaft on which said cutter is mounted, the end of said shaft gripping into said coupling member and being furnished with a flattened portion which is in non-torsional engagement with a flattened portion that is matingly designed in a bore of said coupling member.

11. Can opener as claimed in claim 2 wherein said coupling member is a flat circular disc with a radial lever arm contacting an eccentric bore.

12. Can opener as claimed in claim 10 wherein said coupling member is undetachably coupled with said shaft.

13. Can opener as claimed in claim 10 wherein said coupling member is detachably coupled with the shaft.

14. Can opener as claimed in claim 10 wherein said shaft is held in axial direction by an unlockable locking bolt engaging into a groove of said shaft.

15. Electrically driven can opener having a housing accommodating a drive motor and a drive mechanism, a drive wheel arranged on the outside of said housing and drivable by said drive motor and said drive mechanism, a switch for energizing said drive motor, a cutter rotatably supported on said housing spaced apart from said drive wheel for severing the lid of a can, an operating member to be actuated by hand and supported on said housing for switching on said drive motor by way of said switch, a spring-elastic portion disposed between said operating member and said cutter which permits tilting of said cutter, said switch being arranged in relation to said operating member such that said switch is switched on by further acutation of said operating member only after said spring-elastic portion has deformed and said cutter has been put into engagement with the can lid, and a stop, the rotatability of said cutter beyond an extreme cutting position being bounded by said stop, and upon actuation of said operating member into the end position of the cutter defined by said stop without a can being severed, said operating member is allowed to be moved further into a position, in which said switch will then be closed, only by stressing said spring-elastic portion disposed between said operating member and said cutter.

16. Can opener as claimed in claim 2 wherein closing of said switch takes place in a tilting area of said operating member in which one end of said spring-elastic portion is in a dead-center position.

* * * * *

UNITED STATES PATENT AND TRADEMARK OFFICE

CERTIFICATE OF CORRECTION

PATENT NO. : 4,922,617

DATED : May 8, 1990

INVENTOR(S) : REINHARD KURZ

It is certified that error appears in the above-identified patent and that said Letters Patent is hereby corrected as shown below:

Col. 4, line 33, insert a period after "shaft".

Col. 5, lines 30-31, "pres-s-on" should be --press-on--.
line 56, "springelastic" should be --spring-elastic--.

Col. 8, line 8, "sadi" should be --said--.
line 24, insert a period after "shaft".
line 25, delete ".".
line 30, "defected" should be --deflected--.
line 38, the numeral "10" should be --7--.

Signed and Sealed this

Fifth Day of November, 1991

*Attest:*

HARRY F. MANBECK, JR.

*Attesting Officer*

*Commissioner of Patents and Trademarks*